United States Patent [19]

Seat

[11] Patent Number: 4,617,989

[45] Date of Patent: Oct. 21, 1986

[54] EXHAUST FLUE HEAT EXCHANGE DEVICE

[76] Inventor: Bobby G. Seat, 3794 Miami, Memphis, Tenn. 38111

[21] Appl. No.: 714,945

[22] Filed: Mar. 22, 1985

[51] Int. Cl.[4] ..... F28F 9/22

[52] U.S. Cl. ..... 165/145; 165/158; 165/901

[58] Field of Search ..... 165/145, 158, 159, 160, 165/901; 126/121

[56] References Cited

U.S. PATENT DOCUMENTS

| | | | |
|---|---|---|---|
| 158,433 | 1/1875 | Munzinger | 165/145 |
| 916,559 | 3/1909 | Jones | 126/121 |
| 1,055,196 | 3/1913 | MacCamy | 165/145 |
| 1,067,689 | 7/1913 | Spotts | 165/145 |
| 3,483,920 | 12/1969 | Heyn et al. | 165/165 |
| 4,096,849 | 6/1978 | Moncrieff-Yeates | 126/121 |
| 4,304,215 | 12/1981 | Jarman | 126/121 |
| 4,441,549 | 4/1984 | Vasiliev et al. | 165/145 X |
| 4,475,587 | 10/1984 | Vasiliev et al. | 165/145 X |

FOREIGN PATENT DOCUMENTS

| | | | |
|---|---|---|---|
| 0065106 | 1/1956 | France | 165/159 |
| 0217192 | 12/1983 | Japan | 165/159 |

*Primary Examiner*—William R. Cline
*Assistant Examiner*—Richard R. Cole
*Attorney, Agent, or Firm*—Walker & McKenzie

[57] ABSTRACT

A heat exchange device for transferring heat from a first medium to a second medium. The device includes a first chamber through which the first medium passes, a second chamber through which the second medium passes, the second chamber having a common boundary with at least a portion of the first chamber, and guide structure for causing the second medium to move in a spiral path through the second chamber and over the common boundary between the first and second chambers.

9 Claims, 9 Drawing Figures

EXHAUST FLUE HEAT EXCHANGE DEVICE

BACKGROUND OF THE INVENTION

1. Field of the Invention

The present invention relates in general to means for extracting heat from a first medium and transferring that heat to a second medium.

2. Description of the Prior Art

It has been estimated that thirty percent or more of heat developed by a primary heat source such as an industrial oven, a residential type fireplace, and the like is lost through the exhaust flue of the heat source. Various means have heretofore been developed in an attempt to save or reclaim heat passing through the exhaust flue of a heat source. Lathrop, U.S. Pat. No. 2,183,458; Kelley et al, U.S. Pat. No. 2,297,776; Brooks, U.S. Pat. No. 2,359,197; Dupler, U.S. Pat. No. 2,622,587; Dupler, U.S. Pat. No. 2,671,440; Dupler, U.S. Pat. No. 3,749,078; and Shaw, U.S. Pat. No. 4,169,458 all disclose fireplace or stove-type heating devices in which the heated exhaust gasses thereof are passed through baffles, adjacent hollow chambers, etc., in an attempt to extract as much heat as possible therefrom. None of the prior attempts disclose or suggest the present invention.

SUMMARY OF THE INVENTION

The present invention is directed toward providing a heat exchange device that will effectively allow a large part (e.g., 40%) of the heat passing through the exhaust flue of a heat source to be reclaimed. The heat exchange device of the present invention comprises, in general, a first chamber having an inlet and an outlet for allowing a first medium (e.g., exhaust flue gasses) to pass therethrough; a second chamber having an inlet and an outlet for allowing a second medium (e.g., air) to pass therethrough, the second chamber having a common boundary with at least a portion of the first chamber; and guide means for causing the second medium to move in a spiral path between the inlet and outlet of the second chamber and over the common boundary between the first and second chambers.

BRIEF DESCRIPTION OF THE PREFERRED EMBODIMENT

Figure 6:
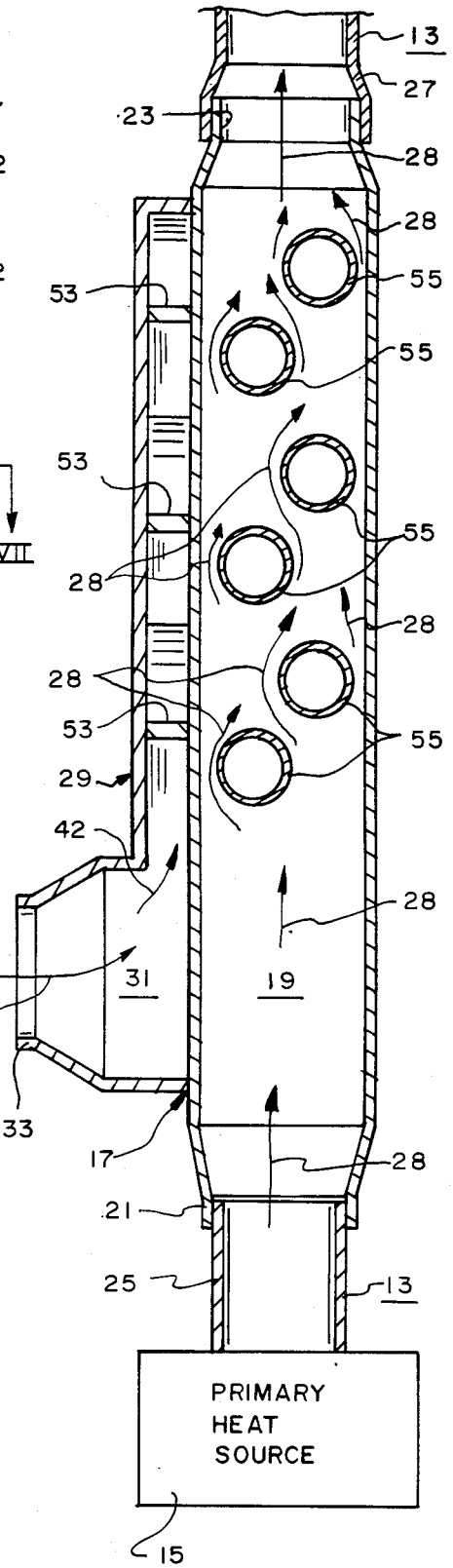
FIG. 6 is a sectional view thereof substantially as taken on line VI—VI of FIG. 5 with a portion of an exhaust flue and a primary heat source shown somewhat diagrammatically.

The heat exchange device 11 of the present invention is used for extracting heat from a first medium and transferring that heat to a second medium. For example, the device 11 may be associated with the exhaust flue 13 of a primary heat source 15 such an as industrial oven or the like (see FIG. 6) in which the first medium consists of the exhaust gasses passing from the heat source 15 through the exhaust flue 13 and in which the second medium may consist of air for being heated by the device 11 and for then being used for any purpose such as, for example, to supplement the primary heat source 15.

Figure 7:
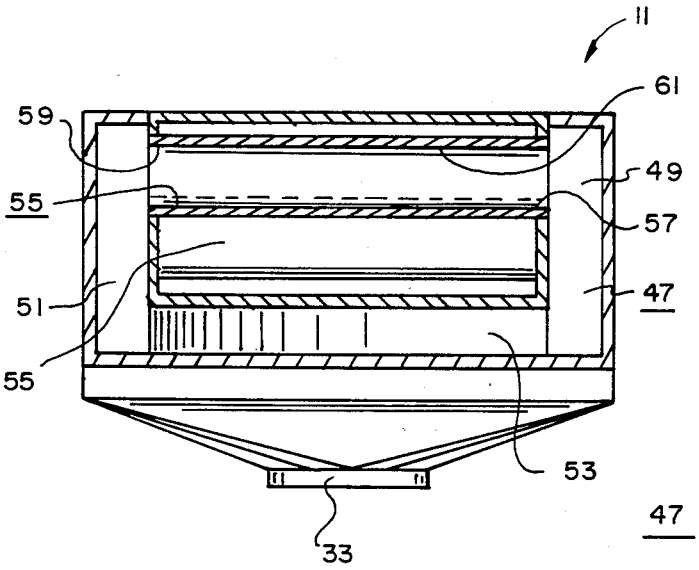
FIG. 7 is a sectional view thereof substantially as taken on line VII—VII of FIG. 5.
Figure 8:
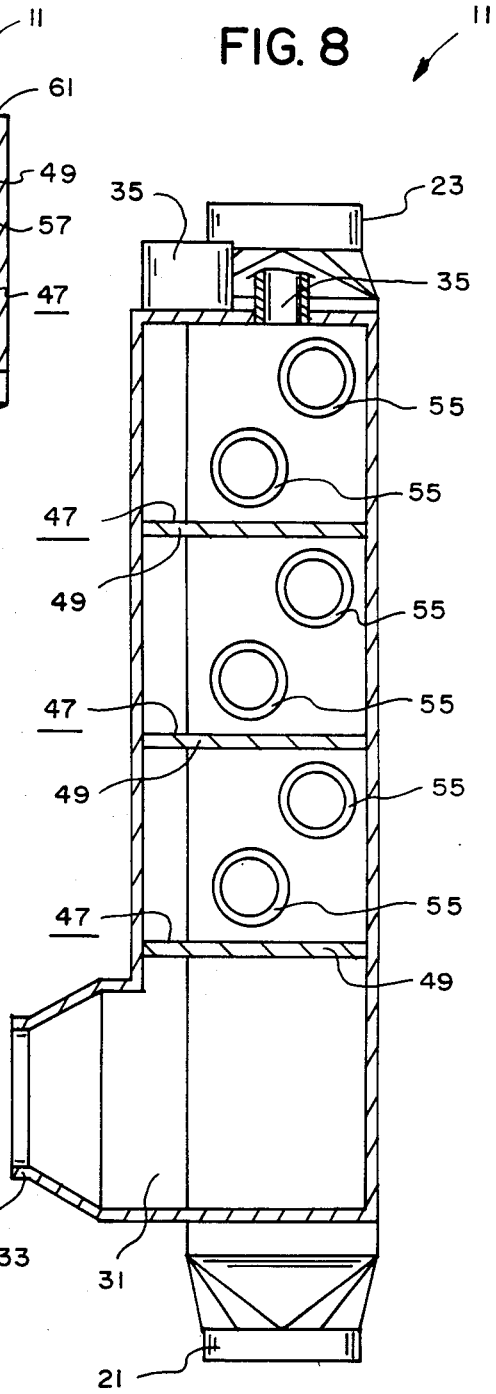
FIG. 8 is a sectional view thereof substantially as taken on line VIII—VIII of FIG. 5.
Figure 9:
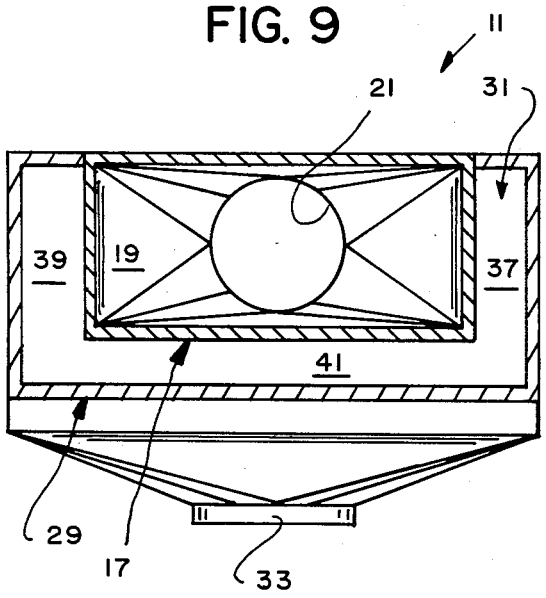
FIG. 9 is a sectional view thereof substantially as taken on line IX—IX of FIG. 5.

The device 11 includes a first chamber 17 having an interior 19, an inlet 21, and an outlet 23 for allowing the first medium to pass therethrough. The interior 19 of the first chamber 17 may be substantially square or rectangular in cross-sectional area (see FIGS. 7 and 9). The inlet 21 may be defined by a single inlet port and the outlet 23 may be defined by a single outlet port having substantially the same cross-sectional area as the inlet port. The exhaust flue 13 preferably includes a first portion 25 for being coupled to the inlet 21 of the first chamber 17 and a second portion 27 for being coupled to the outlet 23 of the first chamber 17 (see FIG. 6) whereby the first chamber 17 forms, in effect, a part of the exhaust flue 13 for allowing exhaust gasses from the heat source 15 to pass therethrough in the direction indicated by the arrows 28 in FIG. 6.

Figure 1:
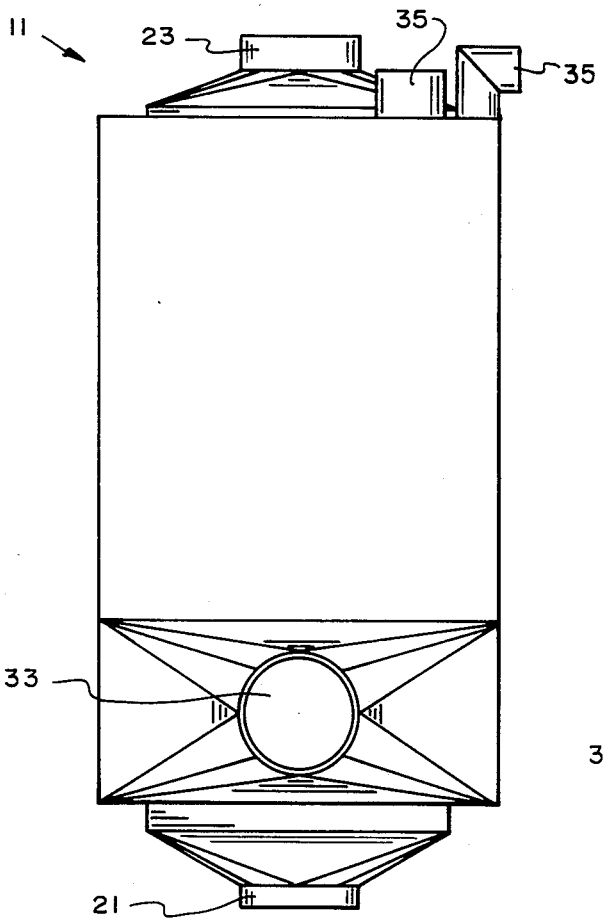
FIG. 1 is a front elevational view of the heat exchange device of the present invention.
Figure 2:
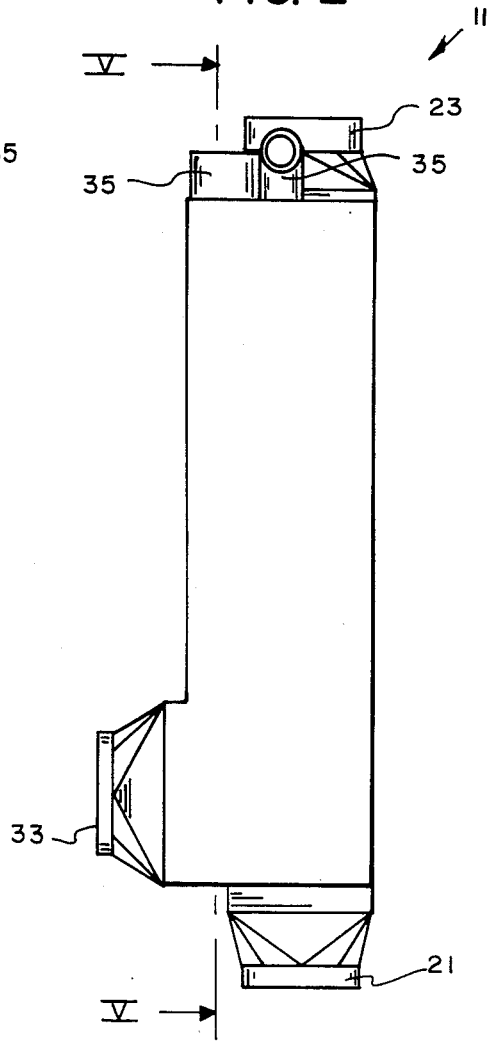
FIG. 2 is a side elevational view thereof.
Figure 3:
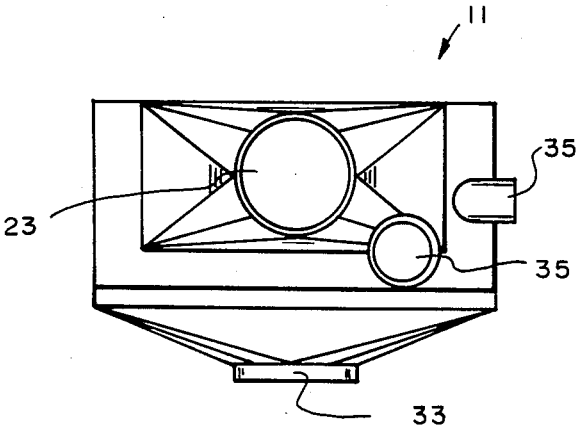
FIG. 3 is a top plan view thereof.
Figure 4:
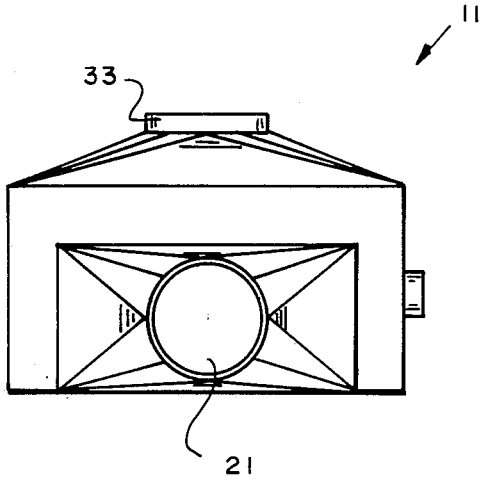
FIG. 4 is a bottom plan view thereof.
Figure 5:
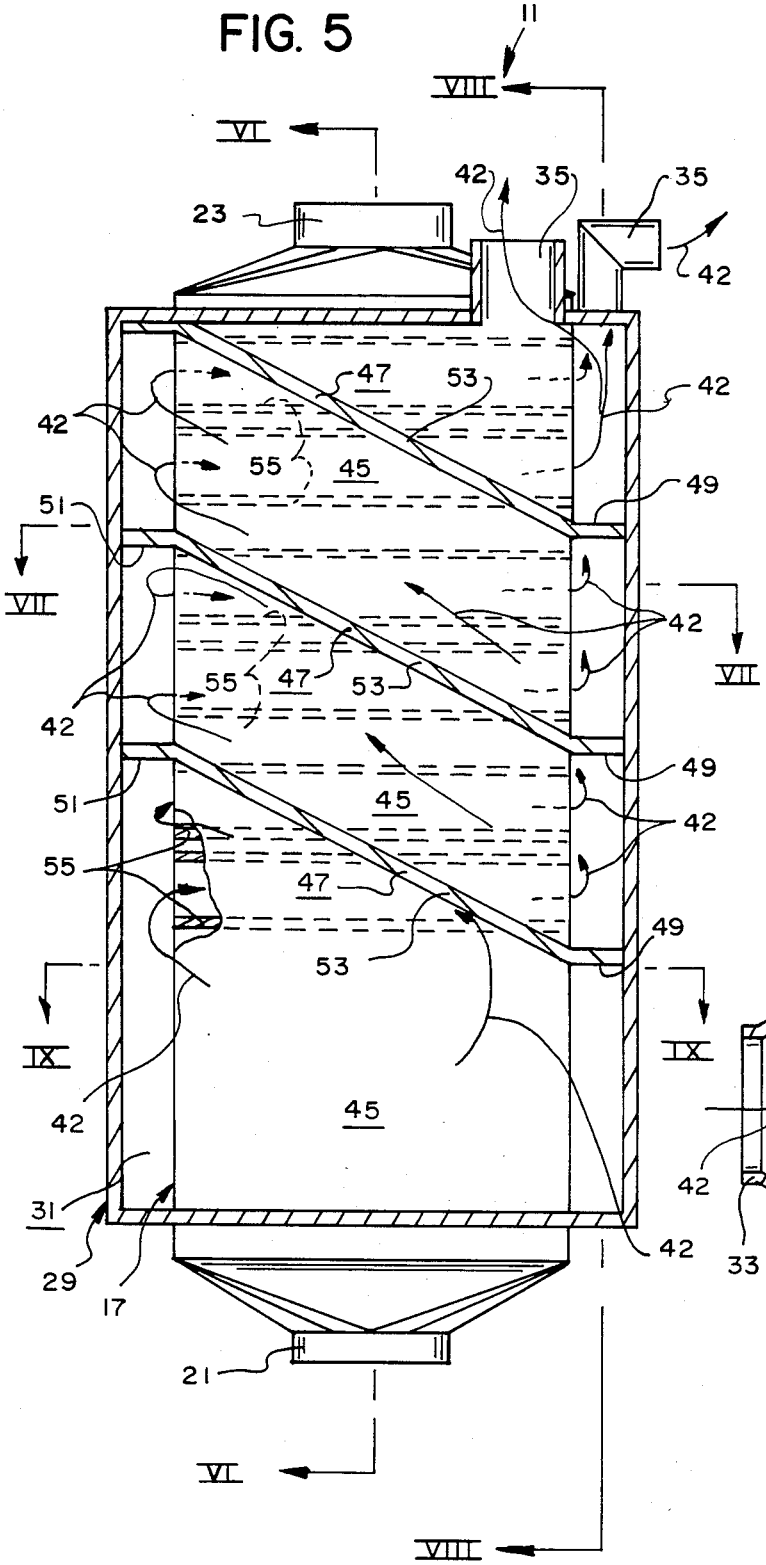
FIG. 5 is an enlarged sectional view substantially as taken on line V—V of FIG. 2.

The device 11 includes a second chamber 29 having an interior 31, an inlet 33, and an outlet 35 for allowing the second medium to pass therethrough. The second chamber 29 has a common boundary with at least a portion of the first chamber 17. More specifically, the first and second chambers 17, 29 may be constructed so that one or more walls of the first chamber 17 also define one or more walls of the second chamber 29. Thus, for example, the interior 31 of the second chamber 29 may have a substantially U-shaped cross-sectional area for covering three sides of the first chamber 17 whereby three walls of the first and second chamber 17, 29 are common (see FIGS. 7 and 9). The U-shaped cross-sectional area of the interior 31 is defined by first and second leg portions 37, 39 and a bight portion 41 joining the one end of the leg portions 37, 39 to one another (see, in general, FIG. 9). The second chamber 29 thus encloses three sides of the first chamber 17. The inlet 33 may be defined by a single inlet port while the outlet 35 may be defined by one or more outlet ports. The cross-sectional area of the outlet 35 is preferably substantially the same as the cross-sectional area of the inlet 33. Thus, due to the specific construction of the preferred embodiment as shown in the drawings, the outlet 35 is defined by a pair of outlet ports that are each relatively smaller in cross-sectional area than the inlet port but have a combined cross-sectional area that is substantially the same as the inlet 35. It should be noted that the second medium may be forced through the interior 31 of the second chamber 29 by a fan or the like (not shown) and the direction of movement of the second medium through the interior 31 will depend upon the direction of flow created by the fan. More specifically, a motorized fan or the like (not shown) may be coupled to the inlet 33 whereby the direction of flow through the interior 31 is as indicated by the arrows 42 in FIGS. 5 and 6. The fan could be coupled to the outlet ports whereby the direction of flow through the interior 31 would be reverse that indicated by the arrows 42. Thus, while the port 33 has been referred to as the inlet port and the ports 35 have been referred to as the outlet ports, it should be understood that if the direction of flow through the interior 31 is reversed, the ports 35 will define inlet ports while the port 33 will define an outlet port.

The device 11 includes guide means for causing the second medium to move in a spiral path through the interior 31 of the second chamber 29 and over the common boundary between the first and second chambers 17, 29. The guide means may include pipe means for allowing the second medium to pass from the interior 31 of the second chamber 29 through the interior 19 of the first chamber 17 and back into the interior 31 of the second chamber 29. The pipe means prevents direct contact between the first and second mediums as the second medium passes through the interior 19 of the first chamber 17 while allowing the second medium to so pass through the interior 19. The guide means also may include baffle means for dividing the interior 31 of the second chamber 29 into a plurality of subchambers 45. The baffle means includes a plurality of baffle members 47 mounted within the interior 31 of the second chamber 29 to divide the interior 31 into the plurality of subchambers 45. Each of the baffle members 47 includes a first end 49, a second end 51, and an incline portion 53 joining the first and second ends 49,51. The first end 49 of each baffle members 47 is positioned within the first leg portions 37 of the interior 31. The second end 51 of each baffle members 47 is positioned in the second leg portion 39 of the interior 31. The incline portion 53 of each baffle members 47 extends across the bight portion 41 of the interior 31. The pipe means includes a pipe member 55 communicating with each of the subchambers 45 and extending between adjacent pairs of the subchambers 45 whereby the baffle members 47 and pipe members 55 define the spiral path between the inlet and outlet 33, 35 of the interior 31 through which the second medium moves. Preferably, the pipe means includes a plurality of pipe members 55 interconnecting each subchamber 45. Each of the pipe members 55 has a first end 57 communicating with the first leg portion 37 of the interior 31, a second end 59 communicating with the second leg portion 39 of the interior 31, and a hollow body portion 61 extending through the interior 19 and joining the first and second ends 57, 59 thereof. The body portion 61 of each pipe member has an unbroken outer wall to prevent direct contact between the first and second mediums as the second medium passes through the pipe members 55.

The specific construction and size of the device 11 may vary as will now be apparent to those skilled in the art. The first and second chambers 17, 29 and baffle members 47 may be constructed of sheet metal in any of various manners now apparent to those skilled in the art such as by being bent and welded to shape. The pipe members 55 may consist merely of metal pipe members welded to the appropriate sheet metal walls defining the first and second chambers 17, 29.

Although the invention has been described and illustrated with respect to a preferred embodiment thereof and a preferred use therefore, it is not to be so limited since changes and modifications can be made therein which are within the full intended scope of the invention.

I claim:

1. A heat exchange device interposed in an exhaust flue for extracting heat from a first medium passing through said flue and transferring that heat to a second medium, said device comprising:

(a) a first chamber having an inlet and an outlet coupled to said flue for allowing said first medium to pass therethrough;

(b) a second chamber having an inlet and an outlet for allowing said second medium to pass therethrough, said second chamber having a common boundary with at least a portion of said first chamber; and (c) guide means for causing said second medium to move between said inlet and outlet of said second chamber and over said common boundary between said first and second chambers, said guide means including baffle means for dividing the interior of said second chamber into at least a first subchamber and a second subchamber and including pipe means having at least one pipe member extending from said first subchamber of said second chamber through the interior of said first chamber and to said second subchamber of said second chamber for allowing said second medium to pass therethrough, said pipe means providing the only pathway for allowing the passage of said second medium between said subchambers said baffle means including at least one incline portion for causing said second medium to move along an incline relative to the longitudinal axis of said first chamber.

2. The device of claim 1 in which said pipe means prevents direct contact between said first and second mediums as said second medium passes through said interior of said first chamber.

3. A heat exchange device interposed in an exhaust flue for extracting heat from a first medium passing through said flue and transferring that heat to a second medium, said device comprising:

(a) a first chamber having an inlet and an outlet coupled to said flue for allowing said first medium to pass therethrough;

(b) a second chamber having an inlet and an outlet for allowing said second medium to pass therethrough, said second chamber having a common boundary with at least a portion of said first chamber; and (c) guide means for causing said second medium to move between said inlet and outlet of said second chamber and over said common boundary between said first and second chambers, said guide means including baffle means for dividing the interior of said second chamber into at least a first subchamber and a second subchamber and including pipe means having at least one pipe member extending from said first subchamber of said second chamber through the interior of said first chamber and to said second subchamber of said second chamber for allowing said second medium to pass therethrough, said pipe means providing the only pathway for allowing the passage of said second medium between said subchambers, said pipe means preventing direct contact between said first and second mediums as said second medium passes through said interior of said first chamber; said baffle means including a plurality of baffle members mounted within said interior of said second chamber to divide said interior of said second chamber into at least first, second and third subchambers, each of said baffle members having first and second ends and an incline portion joining said first and second ends, said pipe means including at least a first pipe member extending from said first subchamber of said second chamber through the interior of said first chamber and to said second subchamber of said second chamber and a second pipe member extending from said second subchamber of said second chamber through the interior of said first chamber and to said third subchamber of said seciond chamber.

4. The device of claim 3 in which said first chamber has a front portion, a first side portion, a second side portion, and a rear portion; in which said pipe members extend substantially horizontally between said first and second side portions of said first chamber; and in which said interior of said second chamber has a substantially U-shaped cross-sectional area for covering said front portion and said first and second side portions of said first chamber, said first and second ends of each of said baffle members being attached relative to said first and second side portions respectively of said first chamber with said incline portion of each of said baffle members being attached relative to said front portion of said first chamber for causing said second medium to move around said first chamber while changing elevation adjacent said front portion of said first chamber and while flowing horizontally in opposite directions through said first and second side portions.

5. The device of claim 4 in which said U-shaped cross-sectional area of said interior of said second chamber is defined by first and second leg portions and a bight portion joining one end of each of said leg portions to one another, and in which each of said pipe members has a first end communicating with said first leg portion of said interior of said second chamber, a second end communicating with said second leg portion of said interior of said second chamber, and a hollow body portion extending through said interior of said first chamber and joining said first and second ends thereof.

6. The device of claim 5 in which said body portion has an unbroken outer wall to prevent direct contact between said first and second mediums as said second medium passes through said pipe members.

7. The device of claim 6 in which the cross-sectional area of said outlet of said second chamber is substantially equal to the cross-sectional area of said inlet of said second chamber.

8. The device of claim 7 in which said inlet of said second chamber includes a single inlet port and in which said outlet of said second chamber includes a pair of outlet ports.

9. A heat exchange device mounted between first and second portions of an exhaust flue or a primary heat source for extracting heat from the exhaust gases of said primary heat source and transferring that heat to a secondary medium as said exhaust gases pass through said exhaust flue to supplement said primary heat source, said device comprising:

(a) a first chamber having an inlet attached to said first portion of said exhaust flue and an outlet attached to said second portion of said exhaust flue for allowing said exhaust of said primary heat source to pass therethrough;

(b) a second chamber having an inlet and an outlet for allowing said secondary medium to pass therethrough, said second chamber having a common boundary with at least a portion of said first chamber; and (c) guide means for causing said secondary medium to move between said inlet and outlet of said second chamber and over said common boundary between said first and second chambers, said guide means including a plurality of baffle members for dividing the interior of said second chamber into at least a first subchamber, a second subchamber and a third subchamber and including at least a first pipe member extending from said first subchamber of said second chamber through the interior of said first chamber and to said second subchamber of said second chamber for allowing said secondary medium to pass therethrough, and a second pipe member extending from said second subchamber of said second chamber through the interior of said first chamber and to said third subchamber of said second chamber for allowing said secondary medium to pass therethrough, said pipe members providing the only pathway for allowing the passage of said secondary medium between said subchambers; at least one of said baffle members having an incline portion for causing said second medium to move along an incline relative to the longitudinal axis of said first chamber.

* * * * *